US008834735B2

(12) United States Patent
Sato et al.

(10) Patent No.: US 8,834,735 B2
(45) Date of Patent: Sep. 16, 2014

(54) PROCESSING AGENTS FOR SYNTHETIC FIBERS, AQUEOUS LIQUIDS THEREOF, PROCESSING METHODS FOR SYNTHETIC FIBERS AND SYNTHETIC FIBERS

(71) Applicant: Takemoto Yushi Kabushiki Kaisha, Gamagori (JP)

(72) Inventors: Takayuki Sato, Gamagori (JP); Yuichiro Murakami, Gamagori (JP); Fumiyoshi Ishikawa, Gamagori (JP); Koji Fujimoto, Gamagori (JP)

(73) Assignee: Takemoto Yushi Kabushiki Kaisha, Gamagori (JP)

( * ) Notice: Subject to any disclaimer, the term of this patent is extended or adjusted under 35 U.S.C. 154(b) by 0 days.

(21) Appl. No.: 13/944,024

(22) Filed: Jul. 17, 2013

(65) Prior Publication Data

US 2014/0090208 A1 Apr. 3, 2014

(30) Foreign Application Priority Data

Sep. 28, 2012 (JP) ..... 2012-215330
Dec. 26, 2012 (JP) ..... 2012-281999

(51) Int. Cl.

| | |
|---|---|
| ***D06M 13/00*** | (2006.01) |
| ***D06M 13/02*** | (2006.01) |
| ***D06M 13/148*** | (2006.01) |
| ***D06M 13/188*** | (2006.01) |
| ***D06M 13/224*** | (2006.01) |
| ***D06M 13/256*** | (2006.01) |
| ***D06M 13/292*** | (2006.01) |
| ***C10M 141/02*** | (2006.01) |
| ***D06B 1/00*** | (2006.01) |
| ***D01F 11/00*** | (2006.01) |
| ***D06M 13/17*** | (2006.01) |

(52) U.S. Cl.

CPC ..... *D06B 1/00* (2013.01); *D06M 13/17* (2013.01); *D06M 13/02* (2013.01); *C10M 141/02* (2013.01); *D06M 13/292* (2013.01); *D06M 13/224* (2013.01); *D01F 11/00* (2013.01); *D06M 13/188* (2013.01); *D06M 13/256* (2013.01); *D06M 13/148* (2013.01)

USPC ..... 252/8.84; 252/8.81; 252/8.82; 8/115.51; 8/115.6; 19/66 R; 428/392; 428/394; 428/395

(58) Field of Classification Search

CPC . C10M 141/02; D06M 13/02; D06M 13/148; D06M 13/17; D06M 13/188; D06M 13/224; D06M 13/256; D06M 13/292; D06B 1/00; D01F 11/00

USPC ..... 252/8.81, 8.82, 8.84; 8/115.51, 115.6; 19/66 R; 428/375, 392, 394, 395

See application file for complete search history.

(56) References Cited

U.S. PATENT DOCUMENTS

| | | | | |
|---|---|---|---|---|
| 3,522,179 | A * | 7/1970 | Le Suer | 508/486 |
| 3,756,972 | A * | 9/1973 | Kobayashi et al. | 252/8.84 |
| 5,269,950 | A * | 12/1993 | Iwamoto et al. | 428/374 |
| 6,245,725 | B1 * | 6/2001 | Tanaka et al. | 508/365 |
| 6,268,316 | B1 * | 7/2001 | Tanaka et al. | 508/291 |
| 6,821,301 | B2 * | 11/2004 | Azuse et al. | 8/115.51 |
| 7,585,427 | B2 * | 9/2009 | Yamakita et al. | 252/8.81 |
| 8,216,952 | B2 | 7/2012 | Oki et al. | |

FOREIGN PATENT DOCUMENTS

| | | |
|---|---|---|
| JP | 2000-017573 | 1/2000 |
| JP | 2001-146684 | 5/2001 |
| JP | 2004-238763 | 8/2004 |
| JP | 2005-146489 | 6/2005 |
| JP | 2005/213676 | 8/2005 |
| JP | 2006-307352 | 11/2006 |
| JP | 2011-074500 | 4/2011 |
| WO | 2008/047474 | 4/2008 |

* cited by examiner

*Primary Examiner* — Anthony J Green
(74) *Attorney, Agent, or Firm* — Weaver Austin Villeneuve & Sampson LLP

(57) ABSTRACT

A processing agent containing five specified kinds of components including esters and ethers as required components is used in the production or fabrication process of synthetic fibers such that superior spinning property is maintained and synthetic fibers with superior yarn quality and dyeing property can be obtained. Aqueous liquids of such processing agents, processing methods using such liquids and synthetic fibers obtained by such methods are also presented.

15 Claims, No Drawings

PROCESSING AGENTS FOR SYNTHETIC FIBERS, AQUEOUS LIQUIDS THEREOF, PROCESSING METHODS FOR SYNTHETIC FIBERS AND SYNTHETIC FIBERS

Priority is claimed on Japanese Patent Applications 2012-215330 filed Sep. 28, 2012 and 2012-281999 filed Dec. 26, 2012.

BACKGROUND OF THE INVENTION

This invention relates to processing agents for synthetic fibers, aqueous liquids of these processing agents, methods of processing synthetic fibers by using such aqueous liquids, and synthetic fibers obtained by methods using such aqueous liquids.

It has been known in the production and fabrication processes of polyester and polyamide synthetic fibers to apply a processing agent for synthetic fibers such as spinning oil either as an aqueous system or as a non-aqueous system. If a processing agent for synthetic fibers is applied as a non-aqueous system, such as in the condition of being diluted with an organic solvent (as described, for example, in Japanese Patent Publications Tokkai 57-199868 and 6-57541), however, problems frequently arise regarding costs, disaster prevention and safety.

If a processing agent for synthetic fibers is applied as a low-concentration aqueous system, such as in the condition of an about 10% emulsion (as described, for example, in Japanese Patent Publication Tokkai 7-216733), on the other hand, the problems regarding costs, disaster prevention and safety can be eliminated but problems frequently arise regarding yarn quality and dyeing property.

It has also been proposed to supply a processing agent for synthetic fibers as an emulsion of a higher concentration such as about 30% or even about 50% (as described, for example, in Japanese Patent Publication Tokkai 6-280160), but the emulsion of the processing agent in such a case would tend to gelate, making it impossible to attach the processing agent to yarns uniformly such that the problem arises as a result that the requested high levels of spinning property, yarn quality and dyeing property cannot simultaneously be attained.

SUMMARY OF THE INVENTION

It is therefore an object of this invention to provide processing agents which can be used in the production and fabrication processes of synthetic fibers so as to attain improved yarn quality and dyeing property while maintaining superior spinning property without causing problems regarding costs, disaster prevention and safety, aqueous liquids thereof, processing methods for synthetic fibers by using such aqueous liquids, and synthetic fibers obtained by such processing methods.

The inventors hereof carried out researches in view of the aforementioned object of the present invention and discovered as a result thereof that processing agents for synthetic fibers containing specified five components at specified ratios should be used and that it is appropriate to form an aqueous liquid of such a processing agent at a concentration in a specified range and to cause it to be adhered to synthetic fibers.

DETAILED DESCRIPTION OF THE INVENTION

This invention relates to a processing agent for synthetic fibers, characterized as comprising Component A in an amount of 20-70 mass %, Component B in an amount of 5-45 mass %, Component C in an amount of 1-20 mass %, Component D in an amount of 5-35 mass %, and Component E in an amount of 1-20 mass % for a total of 100 mass %, wherein Components A, B, C, D and E are defined as follows.

Component A is an ester oil with a total of 10-100 carbon atoms and/or a mineral oil with kinetic viscosity at 30° C. of 1-500 $mm^2/s$. Component B is one or more selected from the group consisting of compounds shown by $R^1—X^1—R^2$, compounds shown by $R^3—X^2—Y^1—X^3—R^4$, castor oil derivatives obtained by esterifying (poly)oxyethylene castor oil ether having within its molecule (poly)oxyethylene group formed with 1-100 oxyethylene units and aliphatic monocarboxylic acid with 6-22 carbon atoms, and hydrogenated castor oil derivatives obtained by esterifying (poly)oxyethylene hydrogenated castor oil ether having within its molecule (poly)oxyethylene group formed with 1-100 oxyethylene units and aliphatic monocarboxylic acid with 6-22 carbon atoms, where $R^1$ is a residual group obtained by removing hydrogen atom from carboxyl group of aliphatic monocarboxylic acid with 6-22 carbon atoms, $X^1$ is a residual group obtained by removing all hydroxyl groups from (poly)ethylene glycol having within its molecule (poly)oxyethylene group formed with 1-20 oxyethylene units, $R^2$ is a residual group obtained by removing hydrogen atom from carboxyl group of aliphatic monocarboxylic acid with 6-22 carbon atoms, a residual group obtained by removing hydrogen atom from hydroxyl group of aliphatic monoalcohol with 6-22 carbon atoms, or hydroxyl group, $R^3$ and $R^4$ are each a residual group obtained by removing hydrogen atom from carboxyl group of aliphatic monocarboxylic acid with 6-22 carbon atoms, $X^2$ and $X^3$ are each a residual group obtained by removing all hydroxyl groups from (poly)ethylene glycol having within its molecule (poly)oxyethylene group formed with 1-20 oxyethylene units, $Y^1$ is a residual group obtained by removing hydrogen atom from carboxyl group of aliphatic dicarboxylic acid with 3-12 carbon atoms. Component C is an ester of sorbitan and aliphatic monocarboxylic acid with 10-22 carbon atoms. Component D is an ethylene oxide and propylene oxide random adduct of aliphatic alcohol with 2-22 carbon atoms with weight average molecular weight of 100-1500. Component E is one or more selected from the group consisting of fatty acid salts, aliphatic phosphates and aliphatic sulfonates.

This invention also relates to an aqueous liquid of such a processing agent for synthetic fibers comprising such a processing agent as described above in an amount of 40-90 mass % and water in an amount of 10-60 mass % for a total of 100 mass %, being stable as evaluated by a specified method of evaluating stability and having kinetic viscosity of 50-300 $mm^2/s$ as measured by a specified method of measuring viscosity. This invention further relates to a processing method of synthetic fibers comprising causing such an aqueous liquid as described above to become adhered to synthetic fibers in an amount of 0.1-5 mass % as processing agent for synthetic fibers. This invention still further relates to synthetic fibers obtained by such a processing method as described above.

Firstly, processing agents for synthetic fibers according to this invention (hereinafter referred to as processing agents of this invention) will be explained. A processing agent of this invention is one that comprises aforementioned Component A in an amount of 20-70 mass %, aforementioned Component B in an amount of 5-45 mass %, aforementioned Component C in an amount of 1-20 mass %, aforementioned Component D in an amount of 5-35 mass % and aforementioned Component E in an amount of 1-20 mass % such that the total would be 100 mass %.

Examples of ester oil with a total of 10-100 carbon atoms in Component A include those obtained by esterifying aliphatic monohydric alcohol such as butyl stearate, octyl stearate, oleyl laurate and oleyl olate with aliphatic monocarboxylic acid, those obtained by esterifying aliphatic polyhydric alcohol such as trimethylol propane monoolate monolaurate and 1,6-hexane diol didecanoate with aliphatic monocarboxylic acid, and those obtained by esterifying aliphatic monohydric alcohol such as diisostearyl tetradecanate, dilauryl adipate and dioleyl azelate with aliphatic polycarboxylic acid. Among the above, however, those obtained by esterifying aliphatic monoalcohol with 6-22 carbon atoms such as octyl stearate, oleyl laurate, oleyl olate and diisostearyl tetradecanate with aliphatic monocarboxylic acid with 6-22 carbon atoms are preferable.

Examples of mineral oil with kinetic viscosity at 30° C. of 1-500 $mm^2/s$ in Component A include fluidic paraffin oils, etc., but fluidic paraffin oils with kinetic viscosity at 30° C. in the range of 1-200 $mm^2/s$ are preferable.

Examples of compound shown by $R^1$—$X^1$—$R^2$ in Compound B include α-hexyl-ω-hydroxy-polyoxyethylene octirate, α-octyl-ω-hydroxy-polyoxyethylene octirate, α-decyl-co-hydroxy-polyoxyethylene octirate, α-dodecyl-ω-hydroxy-polyoxyethylene octirate, α-tetradecyl-ω-hydroxy-polyoxyethylene octirate, α-hexadecyl-ω-hydroxy-polyoxyethylene octirate, α-octadecyl-ω-hydroxy-polyoxyethylene octirate, α-octadecenyl-ω-hydroxy-polyoxyethylene octirate, α-eicosyl-ω-hydroxy-polyoxyethylene octirate, α-hexyl-ω-hydroxy-polyoxyethylene decanate, α-octyl-ω-hydroxy-polyoxyethylene decanate, α-decyl-ω-hydroxy-polyoxyethylene decanate, α-dodecyl-ω-hydroxy-polyoxyethylene decanate, α-tetradecyl-ω-hydroxy-polyoxyethylene decanate, α-hexadecyl-ω-hydroxy-polyoxyethylene decanate, α-octadecyl-ω-hydroxy-polyoxyethylene decanate, α-octadecenyl-ω-hydroxy-polyoxyethylene decanate, α-eicosyl-ω-hydroxy-polyoxyethylene decanate, α-hexyl-ω-hydroxy-polyoxyethylene dodecanate, α-octyl-ω-hydroxy-polyoxyethylene dodecanate, α-decyl-ω-hydroxy-polyoxyethylene dodecanate, α-dodecyl-ω-hydroxy-polyoxyethylene dodecanate, α-tetradecyl-ω-hydroxy-polyoxyethylene dodecanate, α-hexadecyl-ω-hydroxy-polyoxyethylene dodecanate, α-octadecyl-ω-hydroxy-polyoxyethylene dodecanate, α-octadecenyl-ω-hydroxy-polyoxyethylene dodecanate, α-eicosyl-ω-hydroxy-polyoxyethylene dodecanate, α-hexyl-ω-hydroxy-polyoxyethylene oleate, α-octyl-ω-hydroxy-polyoxyethylene oleate, α-decyl-ω-hydroxy-polyoxyethylene oleate, α-dodecyl-ω-hydroxy-polyoxyethylene oleate, α-tetradecyl-ω-hydroxy-polyoxyethylene oleate, α-hexadecyl-ω-hydroxy-polyoxyethylene oleate, α-octadecyl-ω-hydroxy-polyoxyethylene oleate, α-octadecenyl-ω-hydroxy-polyoxyethylene oleate, α-eicosyl-ω-hydroxy-polyoxyethylene oleate, polyoxyethylene octyrate, polyoxyethylene decanate, polyoxyethylene dodecanate, polyoxyethylene oleate, polyoxyethylene stearate, polyoxyethylene dioctirate, polyoxyethylene didecanate, polyoxyethylene didodecanate, polyoxyethylene dioleate, and polyoxyethylene distearate.

Examples of compound shown by $R^3$—$X^2$—$Y^1$—$X^3$—$R^4$ in Compound B include bis(α-octyl-ω-hydroxy-polyoxyethylene) succinate, bis(α-octyl-ω-hydroxy-polyoxyethylene) adipate, bis(α-octyl-ω-hydroxy-polyoxyethylene) sebacate, bis(α-decyl-ω-hydroxy-polyoxyethylene) succinate, bis(α-decyl-ω-hydroxy-polyoxyethylene) adipate, bis(α-decyl-ω-hydroxy-polyoxyethylene) sebacate, bis(α-dodecyl-ω-hydroxy-polyoxyethylene) succinate, bis(α-dodecyl-ω-hydroxy-polyoxyethylene) adipate, and bis(α-dodecyl-ω-hydroxy-polyoxyethylene) sebacate.

Examples of castor oil derivative obtained by esterifying (poly)oxyethylene castor oil ether having within its molecule (poly)oxyethylene group formed with 1-100 oxyethylene units and aliphatic monocarboxylic acid with 6-22 carbon atoms include partial esters of one mole of (poly)oxyethylene castor oil ether and one mole of aliphatic monocarboxylic acid with 6-22 carbon atoms, partial esters of one mole of (poly)oxyethylene castor oil ether and 2 moles of aliphatic monocarboxylic acid with 6-22 carbon atoms, and partial esters of one mole of (poly)oxyethylene castor oil ether and 3 moles of aliphatic monocarboxylic acid with 6-22 carbon atoms.

Examples of hydrogenated castor oil derivatives obtained by esterifying (poly)oxyethylene hydrogenated castor oil ether having within its molecule (poly)oxyethylene group formed with 1-100 oxyethylene units and aliphatic monocarboxylic acid with 6-22 carbon atoms include partial esters of one mole of (poly)oxyethylene hydrogenated castor oil ether and one mole of aliphatic monocarboxylic acid with 6-22 carbon atoms, partial esters of one mole of (poly)oxyethylene hydrogenated castor oil ether and 2 moles of aliphatic monocarboxylic acid with 6-22 carbon atoms, and partial esters of one mole of (poly)oxyethylene hydrogenated castor oil ether and 3 moles of aliphatic monocarboxylic acid with 6-22 carbon atoms.

$R^1$, $R^3$ and $R^4$ in $R^1$—$X^1$—$R^2$ or $R^3$—$X^2$—$Y^1$—$X^3$—$R^4$ are each a residual group obtained by removing hydrogen atom from carboxylic group of aliphatic monocarboxylic acid with 6-22 carbon atoms such as caproic acid, caprylic acid, 2-ethylhexanoic acid, capric acid, lauric acid, myristic acid, palmitic acid, oleic acid and stearic acid.

$R^2$ in $R^1$—$X^1$—$R^2$ is a residual group obtained by removing hydrogen atom from carboxyl group of aliphatic monocarboxylic acid of the kind described above regarding $R^1$, $R^3$ and $R^4$, a residual group obtained hydrogen atom from hydroxyl group of aliphatic monoalcohol with 6-22 carbon atoms, or hydroxyl group.

$X^1$, $X^2$ and $X^3$ in $R^1$—$X^1$—$R^2$ or $R^3$—$X^2$—$Y^1$—$X^3$—$R^4$ are each a residual group obtained by removing all hydroxyl groups from (poly)ethylene glycol having within its molecule (poly)oxyethylene group formed with 1-20 oxyethylene units.

$Y^1$ in $R^3$—$X^2$—$Y^1$—$X^3$—$R^4$ is a residual group obtained by removing hydrogen atom from carboxylic group of aliphatic dicarboxylic acid with 3-12 carbons such as malonic acid, succinic acid, adipic acid, fumaric acid, sebacic acid and azelaic acid.

Examples of Component C include esters of sorbitan and aliphatic monocarboxylic acid with 10-22 carbon atoms such as sorbitan monodecanate, sorbitan monododecanate, sorbitan monolaurate, sorbitan monolaurate, sorbitan monostearate, sorbitan sesquilaurate, sorbitan sesquiolate, sorbitan trilaurate, sorbitan triolate, and sorbitan tristearate.

Examples of Component D include ethylene oxide and propylene oxide random adducts of aliphatic alcohol with 2-22 carbon atoms such as straight-chain aliphatic alcohols such as ethyl alcohol, propyl alcohol, butyl alcohol, hexyl alcohol, octyl alcohol, nonyl alcohol, decyl alcohol, dodecyl alcohol and tridecyl alcohol and branched aliphatic alcohols such as isooctyl alcohol, 2-methyl-pentyl alcohol, 2-ethyl-hexyl alcohol, 2-methyloctyl alcohol, 2-propylheptyl alcohol, and 2-butyl-octylalcohol, having weight average molecular weight of 100-1500, but those comprising Component $D^1$ which is defined as an ethylene oxide and propylene oxide random adduct of aliphatic monoalcohol with 2-8 carbon atoms, having weight average molecular weight in the range of 600-1200 and Component $D^2$ which is defined as an ethylene oxide and propylene oxide random adduct of aliphatic monoalcohol with 10-18 carbon atoms, having weight average molecular weight in the range of 300-900 such that the mass ratio $D^1/(D^1+D^2)$ is within the range of 0.20-0.60 are preferred.

Examples of Component $D^1$ include ethylene oxide and propylene oxide random adducts of aliphatic monoalcohol with 2-8 carbon atoms such as ethyl alcohol, propyl alcohol, butyl alcohol, hexyl alcohol, and octyl alcohol, having weight average molecular weight in the range of 600-1200.

Examples of Component $D^2$ include ethylene oxide and propylene oxide random adducts of aliphatic monoalcohol with 10-18 carbon atoms such as undecyl alcohol, dodecyl alcohol, tridecyl alcohol, tetradecyl alcohol, pentadecyl alcohol, hexadecyl alcohol, 2-butyl-octyl alcohol, 2-pentyl-nonyl alcohol, and 2-hexyl-decyl alcohol, having weight average molecular weight in the range of 300-900.

Examples of Component E include salts of aliphatic acid such as propionic acid, hexanoic acid, octanoic acid, octylic acid, decanoic acid and lauric acid, aliphatic phophates such as potassium polyoxy lauryl phosphate and potassium polyoxyoleyl phosphate, and aliphatic sulfonates such as sodium decan sulfonate, sodium dodecan sulfonate, lithium tetradecan sulfonate, potassium hexadecane sulfonate, sodium butylbenzene sulfonate, potassium tetradecyl benzene sulfonate, and potassium octadecyl benzene sulfonate.

Processing agents of this invention contains Component A as explained above in an amount of 20-70 mass %, Component B in an amount of 5-45 mass %, Component C in an amount of 1-20 mass %, Component D in an amount of 5-35 mass % and Component E in an amount of 1-20 mass % for a total of 100 mass % but those containing Component A in an amount of 30-60 mass %, Component B in an amount of 15-35 mass %, Component C in an amount of 5-15 mass %, Component D in an amount of 5-20 mass % and Component E in an amount of 5-15 mass % for a total of 100 mass % are preferable.

Processing agents of this invention may include other components such as an antifoaming agent, an antioxidant, an antiseptic agent and an antirust agent, depending on the purpose of use. Their contents, however, should be as small as possible within the limit of not adversely affecting the objects of this invention.

Next, the aqueous liquids of processing agents for synthetic fibers according to this invention (hereinafter referred to as aqueous liquids of this invention) will be explained. An aqueous liquid of this invention is characterized as comprising a processing agent of this invention in an amount of 40-90 mass % and water in an amount of 10-60 mass % for a total of 100 mass %, evaluated as being stable by a specified method of evaluating stability and having kinetic viscosity in the range of 50-300 $mm^2/s$ as measured by a specified method of measuring kinetic viscosity.

According to the aforementioned specified method of evaluating stability, aqueous liquids containing a sample processing agent for synthetic fibers in amounts of 40 mass %, 50 mass %, 60 mass %, 70 mass % and 90 mass % are prepared each in an amount of 100 ml and placed in a 200 ml-beaker. Each beaker is left quietly for two weeks at 40° C. with its top open, and the sample is evaluated to be stable if there is no separation.

According to the aforementioned specified method of measuring kinetic viscosity, aqueous liquids containing a sample processing agent for synthetic fibers in amounts of 40 mass %, 50 mass %, 60 mass %, 70 mass % and 90 mass % are prepared each in an amount of 100 ml and the kinetic viscosity of each sample at 30° C. is measured (in units of $mm^2/s$) by the Canon-Fenske method.

Aqueous liquids of this invention are characterized as comprising a processing agent of this invention in an amount of 40-90 mass % and water in an amount of 10-60 mass % for a total of 100 mass % but those comprising a processing agent of this invention in an amount of 40-70 mass % and water in an amount of 30-60 mass % for a total of 100 mass % are preferable.

Next, methods of processing synthetic fibers according to this invention (hereinafter referred to as processing methods of this invention) are explained. The processing methods of this invention comprise causing an aqueous liquid of this invention as explained above to become adhered to synthetic fibers in an amount of 0.1-5 mass % or preferably in an amount of 0.5-2 mass % with respect to synthetic fibers as processing agent of this invention. The process in which an aqueous liquid of this invention becomes adhered may be the spinning process, the drawing process or a process in which spinning and drawing are carried out simultaneously. Examples of method for causing an aqueous liquid of this invention to become adhered to synthetic fibers include the roller oiling method, the guide oiling method using a measuring pump, the immersion oiling method and the spray oiling method. Examples of synthetic fibers include polyester fibers, polyamide fibers, polyolefin fibers and acryl fibers but the effects of the invention are manifested prominently in the case of polyester fibers.

Finally, synthetic fibers related to the present invention are explained. Synthetic fibers according to this invention are those obtained by a processing method of this invention explained above.

The present invention as explained above has the effect of making it possible to apply a processing agent for synthetic fibers as an aqueous system at a high concentration in the production or fabrication process of the synthetic fibers and not only to operate with superior workability but also to obtain synthetic fibers with superior yarn quality and dyeing property.

EXAMPLES

Examples are presented next in order to more clearly demonstrate the details and the effects of the present invention but they are not intended to limit the scope of this invention. In what follows, "parts" will means "mass parts" and "%" will mean "mass %".

Part 1 Preparation of Processing Agents for Synthetic Fibers

Test Example 1

Processing Agent (P-1) for synthetic fibers was prepared by uniformly mixing together Components (A-1) and (A-2) shown in Table 1 below each in an amount of 22% as Component A, Components (B-1), (B-3), (B-8), (B-9), (B-11) and (B-12) shown in Table 2 below respectively in an amount of 6%, 3%, 3%, 2%, 3% and 6% as Component B, Components (C-1) and (C-2) shown in Table 3 below respectively in an amount of 2% and 5% as Component C, Component ($D^1$-1) shown in Table 4 below and Component ($D^2$-1) shown in Table 5 below respectively in an amount of 5% and 8% as Component D, and Components (E-1), (E-2) and (E-3) shown in Table 6 below respectively in an amount of 3%, 5% and 5% as Component E for a total of 100 mass %.

Test Examples 2-16 and Comparison Examples 1-7

Processing Agents (P-2)-(P-16) for synthetic fibers of Test Examples 2-16 and Processing Agents (R-1)-(R-7) for synthetic fibers of Comparison Examples 1-7 were prepared as done for Test Example 1. The details of the components which were used for their preparation are shown also in Tables 1-6, and the details of the processing agents prepared in these Examples are shown in Tables 7-9.

TABLE 1

| Kind | Component A | Kinetic viscosity at 30° C. ($mm^2/s$) |
|---|---|---|
| A-1 | Fluidic paraffin oil | 47 |
| A-2 | Lauryl oleate | — |
| A-3 | Octyl palmitate | — |
| A-4 | Isotridecyl stearate | — |

TABLE 2

| Kind | Component B |
|---|---|
| B-1 | Polyoxyethylene (20 mole) hydrogenated castor oil ether dioleate |
| B-2 | Polyoxyethylene (15 mole) hydrogenated castor oil ether trioleate |
| B-3 | Polyoxyethylene (25 mole) hydrogenated castor oil ether trilaurate |
| B-4 | Polyoxyethylene (12 mole) hydrogenated castor oil ether dioleate |
| B-5 | Polyoxyethylene (20 mole) hydrogenated castor oil ether trioleate |
| B-6 | Polyoxyethylene (15 mole) hydrogenated castor oil ether dilaurate |
| B-7 | Polyoxyethylene (30 mole) hydrogenated castor oil ether dioleate |
| B-8 | Bis(polyoxyethylene (3 mole) C12, 13 ether) adipate |
| B-9 | Polyoxyethylene (7 mole) octyl alcohol ether laurate |
| B-10 | Polyoxyethylene (3 mole) lauryl alcohol ether octylate |
| B-11 | Polyoxyethylene glycol (3 mole) monooleate |
| B-12 | Polyoxyethylene glycol (6 mole) dioleate |
| B-13 | Polyoxyethylene glycol (4 mole) dilaurate |

TABLE 3

| Kind | Component C |
|---|---|
| C-1 | Sorbitan sesquioleate |
| C-2 | Sorbitan monooleate |
| C-3 | Sorbitan trioleate |

TABLE 4

| Kind | Component D | Attachment Form | Weight average molecular weight (Mw) |
|---|---|---|---|
| $D^1$-1 | Polyoxyethylene (9 mole) polyoxypropylene (4 mole) butanol ether | Random | 702 |
| $D^1$-2 | Polyoxyethylene (8 mole) polyoxypropylene (4 mole) butanol ether | Random | 658 |
| $D^1$-3 | Polyoxyethylene (11 mole) polyoxypropylene (9 mole) butanol ether | Random | 1080 |
| $D^1$-4 | Polyoxyethylene (6 mole) polyoxypropylene (3 mole) butanol ether | Random | 512 |

TABLE 4-continued

| Kind | Component D | Attachment Form | Weight average molecular weight (Mw) |
|---|---|---|---|
| $D^1$-5 | Polyoxyethylene (10 mole) polyoxypropylene (13 mole) butanol ether | Random | 1268 |
| $D^1$-6 | Polyopxypropylene (5 mole) butanol ether | Random | 364 |
| $d^1$-1 | Polyoxyethylene (9 mole) polyoxypropylene (4 mole) butanol ether | Block | 702 |

TABLE 5

| Kind | Component D | Attachment Form | Weight average molecular weight (Mw) |
|---|---|---|---|
| $D^2$-1 | Polyoxyethylene (3 mole) polyoxypropylene (3 mole) lauryl ether | Random | 492 |
| $D^2$-2 | Polyoxyethylene (2 mole) polyoxypropylene (2 mole) lauryl ether | Random | 390 |
| $D^2$-3 | Polyoxyethylene (12 mole) polyoxypropylene (9 mole) lauryl ether | Random | 1236 |
| $D^2$-4 | Polyoxyethylene (8 mole) polyoxypropylene (8 mole) isotridecanol ether | Random | 1016 |
| $d^2$-1 | Polyoxyethylene (3 mole) polyoxypropylene (3 mole) lauryl ether | Block | 492 |
| $d^2$-2 | Polyopxypropylene (2 mole) lauryl ether | Block | 302 |
| $d^2$-3 | Polyoxyethylene (15 mole) polyoxypropylene (15 mole) lauryl ether | Random | 1716 |

TABLE 6

| Kind | Component E |
|---|---|
| E-1 | Potassium octylate |
| E-2 | Sodium pentadecan sulfonate |
| E-3 | Polyoxyethylene (4 mole) lauryl phosphate ester = polyoxyethylene (4 mole) lauryl aminoether |

TABLE 7

| | | Component A | | | Component B | | | Component C | | | Component D | | | Component E | | |
|---|---|---|---|---|---|---|---|---|---|---|---|---|---|---|---|---|
| TE | Kd | *1 | *2 | *3 | *1 | *2 | *3 | *1 | *2 | *3 | *1 | *2 | *3 | *1 | *2 | *3 |
| 1 | P-1 | A-1 | 22 | 44 | B-1 | 6 | 23 | C-1 | 2 | 7 | $D^1$-1 | 5 | 13 | E-1 | 3 | 13 |
| | | A-2 | 22 | | B-3 | 3 | | C-2 | 5 | | $D^2$-1 | 8 | | E-2 | 5 | |
| | | | | | B-8 | 3 | | | | | | | | E-3 | 5 | |
| | | | | | B-9 | 2 | | | | | | | | | | |
| | | | | | B-11 | 3 | | | | | | | | | | |
| | | | | | B-12 | 6 | | | | | | | | | | |
| 2 | P-2 | A-1 | 13 | 50 | B-1 | 6 | 23 | C-1 | 2 | 7 | $D^1$-1 | 2 | 5 | E-1 | 5 | 15 |
| | | A-2 | 37 | | B-3 | 3 | | C-2 | 5 | | $D^2$-1 | 3 | | E-2 | 5 | |
| | | | | | B-8 | 3 | | | | | | | | E-3 | 5 | |
| | | | | | B-9 | 2 | | | | | | | | | | |
| | | | | | B-11 | 3 | | | | | | | | | | |
| | | | | | B-13 | 6 | | | | | | | | | | |
| 3 | P-3 | A-2 | 48 | 48 | B-1 | 7 | 24 | C-1 | 4 | 9 | $D^1$-2 | 3 | 9 | E-2 | 5 | 10 |
| | | | | | B-2 | 3 | | C-2 | 5 | | $D^2$-1 | 6 | | E-3 | 5 | |
| | | | | | B-9 | 2 | | | | | | | | | | |
| | | | | | B-10 | 3 | | | | | | | | | | |
| | | | | | B-11 | 3 | | | | | | | | | | |
| | | | | | B-13 | 6 | | | | | | | | | | |
| 4 | P-4 | A-1 | 20 | 45 | B-2 | 5 | 22 | C-1 | 3 | 9 | $D^1$-1 | 4 | 13 | E-1 | 1 | 11 |
| | | A-2 | 25 | | B-4 | 4 | | C-2 | 6 | | $D^2$-2 | 9 | | E-2 | 5 | |
| | | | | | B-8 | 3 | | | | | | | | E-3 | 5 | |
| | | | | | B-9 | 3 | | | | | | | | | | |
| | | | | | B-11 | 3 | | | | | | | | | | |
| | | | | | B-12 | 4 | | | | | | | | | | |
| 5 | P-5 | A-1 | 23 | 44 | B-1 | 6 | 23 | C-1 | 2 | 7 | $D^1$-3 | 5 | 13 | E-1 | 3 | 13 |
| | | A-2 | 21 | | B-4 | 3 | | C-2 | 5 | | $D^2$-1 | 8 | | E-2 | 5 | |
| | | | | | B-8 | 3 | | | | | | | | E-3 | 5 | |
| | | | | | B-9 | 2 | | | | | | | | | | |
| | | | | | B-11 | 3 | | | | | | | | | | |
| | | | | | B-12 | 6 | | | | | | | | | | |
| 6 | P-6 | A-1 | 19 | 41 | B-4 | 6 | 23 | C-1 | 3 | 11 | $D^1$-1 | 4 | 12 | E-1 | 3 | 13 |
| | | A-2 | 22 | | B-6 | 3 | | C-2 | 8 | | $D^2$-1 | 8 | | E-2 | 5 | |
| | | | | | B-8 | 3 | | | | | | | | E-3 | 5 | |
| | | | | | B-9 | 2 | | | | | | | | | | |
| | | | | | B-11 | 3 | | | | | | | | | | |
| | | | | | B-12 | 6 | | | | | | | | | | |
| 7 | P-7 | A-1 | 20 | 41 | B-5 | 5 | 23 | C-2 | 4 | 10 | $D^1$-1 | 6 | 13 | E-1 | 3 | 13 |
| | | A-2 | 21 | | B-7 | 4 | | C-3 | 6 | | $D^2$-2 | 7 | | E-2 | 5 | |
| | | | | | B-8 | 3 | | | | | | | | E-3 | 5 | |
| | | | | | B-9 | 2 | | | | | | | | | | |
| | | | | | B-11 | 3 | | | | | | | | | | |
| | | | | | B-12 | 6 | | | | | | | | | | |
| 8 | P-8 | A-1 | 20 | 42 | B-3 | 5 | 21 | C-1 | 3 | 9 | $D^1$-1 | 6 | 15 | E-1 | 3 | 13 |
| | | A-2 | 22 | | B-6 | 2 | | C-2 | 6 | | $D^2$-1 | 9 | | E-2 | 5 | |
| | | | | | B-8 | 3 | | | | | | | | E-3 | 5 | |
| | | | | | B-9 | 2 | | | | | | | | | | |
| | | | | | B-11 | 3 | | | | | | | | | | |
| | | | | | B-12 | 6 | | | | | | | | | | |

TABLE 8

| | | Component A | | | Component B | | | Component C | | | Component D | | | Component E | | |
|---|---|---|---|---|---|---|---|---|---|---|---|---|---|---|---|---|
| TE | Kd | *1 | *2 | *3 | *1 | *2 | *3 | *1 | *2 | *3 | *1 | *2 | *3 | *1 | *2 | *3 |
| 9 | P-9 | A-1 | 20 | 44 | B-2 | 5 | 24 | C-2 | 6 | 9 | $D^1$-2 | 5 | 10 | E-1 | 3 | 13 |
| | | A-2 | 24 | | B-5 | 3 | | C-3 | 3 | | $D^2$-1 | 5 | | E-2 | 5 | |
| | | | | | B-8 | 5 | | | | | | | | E-3 | 5 | |
| | | | | | B-9 | 3 | | | | | | | | | | |
| | | | | | B-11 | 2 | | | | | | | | | | |
| | | | | | B-12 | 6 | | | | | | | | | | |
| 10 | P-10 | A-1 | 10 | 40 | B-1 | 6 | 23 | C-1 | 4 | 11 | $D^1$-1 | 6 | 16 | E-2 | 5 | 10 |
| | | A-3 | 30 | | B-2 | 4 | | C-2 | 7 | | $D^2$-1 | 10 | | E-3 | 5 | |
| | | | | | B-8 | 3 | | | | | | | | | | |
| | | | | | B-9 | 2 | | | | | | | | | | |
| | | | | | B-10 | 3 | | | | | | | | | | |
| | | | | | B-12 | 5 | | | | | | | | | | |
| 11 | P-11 | A-1 | 23 | 35 | B-1 | 5 | 30 | C-1 | 4 | 12 | $D^1$-2 | 5 | 9 | E-1 | 4 | 14 |
| | | A-4 | 12 | | B-2 | 6 | | C-2 | 8 | | $D^2$-1 | 4 | | E-2 | 5 | |
| | | | | | B-8 | 3 | | | | | | | | E-3 | 5 | |
| | | | | | B-9 | 4 | | | | | | | | | | |
| | | | | | B-11 | 6 | | | | | | | | | | |
| | | | | | B-12 | 6 | | | | | | | | | | |

TABLE 8-continued

| | | Component A | | | Component B | | | Component C | | | Component D | | | Component E | | |
|---|---|---|---|---|---|---|---|---|---|---|---|---|---|---|---|---|
| TE | Kd | *1 | *2 | *3 | *1 | *2 | *3 | *1 | *2 | *3 | *1 | *2 | *3 | *1 | *2 | *3 |
| 12 | P-12 | A-1 | 25 | 50 | B-1 | 5 | 18 | C-2 | 5 | 5 | $D^1$-1 | 6 | 15 | E-1 | 2 | 12 |
| | | A-2 | 25 | | B-2 | 3 | | | | | $D^2$-1 | 9 | | E-2 | 5 | |
| | | | | | B-9 | 2 | | | | | | | | E-3 | 5 | |
| | | | | | B-11 | 3 | | | | | | | | | | |
| | | | | | B-12 | 5 | | | | | | | | | | |
| 13 | P-13 | A-1 | 23 | 46 | B-1 | 3 | 22 | C-1 | 3 | 9 | $D^1$-5 | 5 | 12 | E-1 | 1 | 11 |
| | | A-2 | 23 | | B-2 | 4 | | C-2 | 6 | | $D^2$-4 | 7 | | E-2 | 5 | |
| | | | | | B-8 | 3 | | | | | | | | E-3 | 5 | |
| | | | | | B-9 | 3 | | | | | | | | | | |
| | | | | | B-11 | 3 | | | | | | | | | | |
| | | | | | B-12 | 6 | | | | | | | | | | |
| 14 | P-14 | A-1 | 23 | 46 | B-1 | 6 | 20 | C-1 | 4 | 9 | $D^1$-6 | 6 | 15 | E-2 | 5 | 10 |
| | | A-2 | 23 | | B-2 | 3 | | C-2 | 5 | | $D^2$-3 | 9 | | E-3 | 5 | |
| | | | | | B-8 | 3 | | | | | | | | | | |
| | | | | | B-9 | 2 | | | | | | | | | | |
| | | | | | B-11 | 3 | | | | | | | | | | |
| | | | | | B-12 | 3 | | | | | | | | | | |
| 15 | P-15 | A-1 | 27 | 54 | B-1 | 11 | 24 | C-2 | 4 | 4 | $D^2$-1 | 7 | 7 | E-2 | 6 | 11 |
| | | A-2 | 27 | | B-2 | 3 | | | | | | | | E-3 | 5 | |
| | | | | | B-9 | 3 | | | | | | | | | | |
| | | | | | B-11 | 3 | | | | | | | | | | |
| | | | | | B-12 | 4 | | | | | | | | | | |
| 16 | P-16 | A-1 | 20 | 42 | B-1 | 7 | 23 | C-1 | 6 | 13 | $D^1$-6 | 2 | 12 | E-2 | 5 | 10 |
| | | A-2 | 22 | | B-2 | 3 | | C-2 | 7 | | $D^2$-3 | 10 | | E-3 | 5 | |
| | | | | | B-8 | 3 | | | | | | | | | | |
| | | | | | B-9 | 3 | | | | | | | | | | |
| | | | | | B-11 | 3 | | | | | | | | | | |
| | | | | | B-13 | 4 | | | | | | | | | | |

TABLE 9

| | | Component A | | | Component B | | | Component C | | | Component D | | | Component E | | |
|---|---|---|---|---|---|---|---|---|---|---|---|---|---|---|---|---|
| CE | Kd | *1 | *2 | *3 | *1 | *2 | *3 | *1 | *2 | *3 | *1 | *2 | *3 | *1 | *2 | *3 |
| 1 | R-1 | A-1 | 24 | 48 | B-1 | 7 | 29 | C-1 | 3 | 9 | | | | E-1 | 4 | 14 |
| | | A-2 | 24 | | B-2 | 4 | | C-2 | 6 | | | | | E-2 | 5 | |
| | | | | | B-8 | 4 | | | | | | | | E-3 | 5 | |
| | | | | | B-9 | 2 | | | | | | | | | | |
| | | | | | B-11 | 5 | | | | | | | | | | |
| | | | | | B-12 | 7 | | | | | | | | | | |
| 2 | R-2 | A-1 | 23 | 46 | B-1 | 6 | 23 | C-1 | 2 | 7 | $d^1$-1 | 11 | 11 | E-1 | 3 | 13 |
| | | A-2 | 23 | | B-3 | 3 | | C-2 | 5 | | | | | E-2 | 5 | |
| | | | | | B-8 | 3 | | | | | | | | E-3 | 5 | |
| | | | | | B-9 | 2 | | | | | | | | | | |
| | | | | | B-11 | 3 | | | | | | | | | | |
| | | | | | B-13 | 6 | | | | | | | | | | |
| 3 | R-3 | A-1 | 23 | 46 | B-2 | 6 | 24 | C-1 | 4 | 10 | $d^2$-1 | 9 | 9 | E-1 | 1 | 11 |
| | | A-2 | 23 | | B-4 | 4 | | C-2 | 6 | | | | | E-2 | 5 | |
| | | | | | B-8 | 3 | | | | | | | | E-3 | 5 | |
| | | | | | B-9 | 2 | | | | | | | | | | |
| | | | | | B-11 | 3 | | | | | | | | | | |
| | | | | | B-12 | 6 | | | | | | | | | | |
| 4 | R-4 | A-1 | 29 | 62 | B-2 | 6 | 24 | | | | $d^2$-1 | 9 | 9 | E-1 | 1 | 5 |
| | | A-2 | 33 | | B-4 | 4 | | | | | | | | E-2 | 2 | |
| | | | | | B-8 | 3 | | | | | | | | E-3 | 2 | |
| | | | | | B-9 | 2 | | | | | | | | | | |
| | | | | | B-11 | 3 | | | | | | | | | | |
| | | | | | B-12 | 6 | | | | | | | | | | |
| 5 | R-5 | A-1 | 20 | 42 | B-3 | 6 | 25 | C-1 | 4 | 10 | $d^1$-1 | 6 | 13 | E-1 | 2 | 10 |
| | | A-2 | 22 | | B-4 | 4 | | C-2 | 6 | | $d^2$-2 | 7 | | E-2 | 3 | |
| | | | | | B-8 | 3 | | | | | | | | E-3 | 5 | |
| | | | | | B-9 | 4 | | | | | | | | | | |
| | | | | | B-10 | 3 | | | | | | | | | | |
| | | | | | B-12 | 5 | | | | | | | | | | |
| 6 | R-6 | A-1 | 9 | 18 | B-2 | 9 | 39 | C-1 | 4 | 10 | $d^1$-1 | 7 | 17 | E-1 | 5 | 16 |
| | | A-2 | 9 | | B-4 | 6 | | C-2 | 6 | | $D^2$-2 | 10 | | E-2 | 6 | |
| | | | | | B-8 | 5 | | | | | | | | E-3 | 5 | |
| | | | | | B-9 | 6 | | | | | | | | | | |
| | | | | | B-10 | 5 | | | | | | | | | | |
| | | | | | B-12 | 8 | | | | | | | | | | |
| 7 | R-7 | A-1 | 16 | 31 | B-2 | 4 | 22 | C-1 | 10 | 25 | $d^2$-3 | 9 | 9 | E-1 | 3 | 13 |
| | | A-2 | 15 | | B-5 | 4 | | C-2 | 15 | | | | | E-2 | 5 | |

TABLE 9-continued

| | Component A | | | Component B | | | Component C | | | Component D | | | Component E | | |
|---|---|---|---|---|---|---|---|---|---|---|---|---|---|---|---|
| CE Kd | *1 | *2 | *3 | *1 | *2 | *3 | *1 | *2 | *3 | *1 | *2 | *3 | *1 | *2 | *3 |
| | | | | B-8 | 3 | | | | | | | | E-3 | 5 | |
| | | | | B-9 | 2 | | | | | | | | | | |
| | | | | B-10 | 3 | | | | | | | | | | |
| | | | | B-12 | 6 | | | | | | | | | | |

In Tables 7, 8 and 9:
TE: Test Example
CE: Comparison Example
Kd: Kind of processing agent for synthetic fibers
*1: Kind
*2: Ratio
*3: Sum of ratios (%)

Part 2 Preparation of Aqueous Liquids of Processing Agents for Synthetic Fibers

Test Example 17

Aqueous liquids of processing agents for synthetic fibers with concentrations 40%, 50%, 60%, 70% and 90% were prepared by uniformly mixing specified amounts of Processing Agent (P-1) for synthetic resin prepared in Part 1 and specified amounts of ion exchange water. A sample of 100 ml was taken from each of these prepared aqueous liquids of processing agents for synthetic fibers, left quietly for 2 weeks at 40° C. in a 200 ml-beaker, and evaluated for its stability, those without separation being evaluated as stable (○) and those with separation being evaluated as unstable (x). Another sample of 100 ml was also taken from each of the aqueous liquids and the kinetic viscosity of each of these samples at 30° C. was also measured in units of ($mm^2/s$) by the Canon-Finske method. The results of the measurement are shown in Table 10.

Test Examples 18-32 and Comparison Examples 8-14

Aqueous liquids of Test Examples 18-32 and Comparison Examples 8-14 of processing liquids for synthetic fibers were prepared as done for Test Example 17. Their stability was evaluated and their kinetic viscosity was measured. These results are also shown in Table 10.

TABLE 10

| | Kind of processing agent | Evaluation of stability | | | | | Kinetic viscosity ($mm^2/s$) | | | | |
|---|---|---|---|---|---|---|---|---|---|---|---|
| | | 40% | 50% | 60% | 70% | 90% | 40% | 50% | 60% | 70% | 90% |
| TE-17 | P-1 | ○ | ○ | ○ | ○ | ○ | 120 | 140 | 140 | 150 | 100 |
| TE-18 | P-2 | ○ | ○ | ○ | ○ | ○ | 60 | 70 | 90 | 80 | 70 |
| TE-19 | P-3 | ○ | ○ | ○ | ○ | ○ | 130 | 160 | 160 | 130 | 95 |
| TE-20 | P-4 | ○ | ○ | ○ | ○ | ○ | 140 | 150 | 160 | 140 | 110 |
| TE-21 | P-5 | ○ | ○ | ○ | ○ | ○ | 150 | 160 | 160 | 170 | 115 |
| TE-22 | P-6 | ○ | ○ | ○ | ○ | ○ | 85 | 95 | 105 | 110 | 90 |
| TE-23 | P-7 | ○ | ○ | ○ | ○ | ○ | 180 | 200 | 190 | 200 | 140 |
| TE-24 | P-8 | ○ | ○ | ○ | ○ | ○ | 150 | 160 | 170 | 140 | 120 |
| TE-25 | P-9 | ○ | ○ | ○ | ○ | ○ | 130 | 160 | 150 | 120 | 100 |
| TE-26 | P-10 | ○ | ○ | ○ | ○ | ○ | 100 | 110 | 120 | 120 | 85 |
| TE-27 | P-11 | ○ | ○ | ○ | ○ | ○ | 120 | 150 | 160 | 140 | 90 |
| TE-28 | P-12 | ○ | ○ | ○ | ○ | ○ | 120 | 190 | 200 | 160 | 100 |
| TE-29 | P-13 | ○ | ○ | ○ | ○ | ○ | 150 | 270 | 290 | 200 | 150 |
| TE-30 | P-14 | ○ | ○ | ○ | ○ | ○ | 110 | 240 | 230 | 200 | 140 |
| TE-31 | P-15 | ○ | ○ | ○ | ○ | ○ | 260 | 280 | 290 | 270 | 165 |
| TE-32 | P-16 | ○ | ○ | ○ | ○ | ○ | 180 | 260 | 280 | 220 | 145 |
| CE-8 | R-1 | x | x | x | x | ○ | *5 | 2500 | *4 | *5 | 110 |
| CE-9 | R-2 | x | x | x | x | ○ | *5 | *4 | 1500 | 350 | 130 |
| CE-10 | R-3 | ○ | x | x | x | ○ | 80 | *5 | *5 | 430 | 100 |
| CE-11 | R-4 | x | x | x | x | x | *5 | *5 | *5 | *5 | 80 |
| CE-12 | R-5 | x | x | x | ○ | ○ | 90 | *5 | *5 | 850 | 80 |
| CE-13 | R-6 | x | ○ | x | x | ○ | 40 | 540 | 620 | 350 | 100 |
| CE-14 | R-7 | x | ○ | ○ | x | ○ | 190 | 340 | 450 | 320 | 160 |

In Table 10:
TE: Test Example
CE: Comparison Example
*4: Measurement could not be taken because of the gelation of the aqueous liquid
*5: Measurement could not be taken because the aqueous liquid did not emulsify and was either non-uniform or separated

Part 3 Production and Evaluation of Synthetic Fibers Having Aqueous Liquid of Processing Agent Applied

Test Example 33

Aqueous liquid of processing agent with concentration of 55% was prepared by uniformly mixing 55 parts of Processing Agent (P-1) for synthetic fibers prepared in Part 1 and 45 parts of ion exchange water. Polyester fibers of 83.3 decitex (75 denier) 36-filament were produced by drying chips of polyethylene terephthalate having intrinsic viscosity 0.64 and containing 0.2% of titanium oxide, thereafter using an extruder for spinning at 295° C., pushing out from the mouthpiece to cool and solidify, thereafter using a guide oiling method which makes use of a metering pump to cause the aforementioned aqueous liquid of processing agent for synthetic fibers to adhere to running yarns at a rate of 1.0% with respect to the running yarns as processing agent for synthetic fibers, thereafter collecting them by means of a guide, taking them up by an adopt roller heated to 90° C. with a speed of 1400 m/minute, and thereafter drawing them at a rate of 3.2 times between the adopt roller and a draw roller which rotates at a rate of 4800 m/minute. The mass of deposit, spinning property, yarn quality and dyeing property as polyester fibers are thus produced were measured and evaluated as follows. The results of the measurements and evaluations are shown in Table 11.

Measurement of Mass of Deposit

A 2 g-mass of the produced polyester fibers was accurately weighed and subjected to an extraction process with 10 ml of a liquid mixture of n-hexane/ethanol=7/3 (volume ratio), and after the extracted liquid was dried for 5 minutes at 100° C. on an accurately weighed aluminum tray, its mass was measured to calculate the agent mass of deposit by the following formula:

$$(\text{Mass of Deposit in } \%)=100\times(B-A)/S$$

where A is the weight of the aluminum tray, B is the weight of the aluminum tray inclusive of the extracted agent, and S is the weight of the fibers used for the extraction.

Evaluation of Spinning Property

Yarn breakage frequency for one ton of yarns at the time of the production of polyester fibers was measured ten times and their average was evaluated as follows:

A: Yarn breakage frequency was less than 0.5 times

B: Yarn breakage frequency was between 0.5 times and 1.0 time

C: Yarn breakage frequency was between 1.0 time and less than 2.0 times

D: Yarn breakage frequency was 2.0 times or more

Evaluation of Yarn Quality

Evenness U % of produced polyester fibers was evaluated by using USTER TESTER UT-5 (produced by USTER Co., Ltd.) at yarn speed of 200 m/minute. Similar evaluations were repeated five times and evaluations were made as follows from each result:

A: Evenness U % was 1.0 or less in all five results

B: Evenness U % was 1.0 or greater in one of the five results

C: Evenness U % was 1.0 or greater in two of the five results

D: Evenness U % was 1.0 or greater in three or more of the five results

Evaluation of Dyeing Property

Fabrics of diameter 70 mm and length 1.2 mm were prepared from the produced polyester fibers by using a knitting machine. Each fabric was dyed by a high-pressure dyeing method by using a disperse dye Kayalon polyester Blue ENL-E (tradename) produced by Nippon Kayaku Co., Ltd. Each dyed fabric was washed with water by a regular method and was set, after being subjected to a reduction cleaning process and dried, to an iron cylinder with diameter 70 mm and length 1.0 mm. Densely dyed spots on the fabric surface were examined by visual observation and their number was counted for evaluation. Similar evaluations were repeated five times and the average value of the numbers of densely dyed spots was evaluated as follows:

A: There was no densely dyed spot

B: There were 1-2 densely dyed spots

C: There were 3-6 densely dyed spots

D: There were 7 or more densely dyed spots.

Test Examples 34-51 and Comparison Examples 15-22

Aqueous liquids of processing agents for synthetic fibers with various concentrations for Test Examples 34-51 and Comparison Examples 15-22 were prepared as done for Test Example 33, polyester fibers were produced, and their spinning property, yarn quality and dyeing property were evaluated. The results are shown in Table 11.

TABLE 11

| | Kind of Processing Agent | Concentration of Aqueous Liquid (%) | Mass of Deposit (%) | Spinning Property | Yarn Quality | Dyeing Property |
|---|---|---|---|---|---|---|
| TE-33 | P-1 | 55 | 1.0 | A | A | A |
| TE-34 | P-1 | 65 | 1.0 | A | A | A |
| TE-35 | P-2 | 70 | 1.1 | A | A | A |
| TE-36 | P-1 | 45 | 0.8 | A | A | A |
| TE-37 | P-2 | 50 | 0.9 | A | A | A |
| TE-38 | P-3 | 60 | 0.9 | A | A | A |
| TE-39 | P-4 | 50 | 1.0 | A | A | A |
| TE-40 | P-5 | 40 | 1.2 | A | A | A |
| TE-41 | P-6 | 60 | 0.8 | A | A | A |
| TE-42 | P-7 | 50 | 0.9 | A | A | A |
| TE-43 | P-8 | 50 | 1.0 | A | A | A |
| TE-44 | P-9 | 55 | 1.0 | A | A | A |
| TE-45 | P-10 | 50 | 0.8 | A | A | A |
| TE-46 | P-11 | 40 | 1.0 | A | A | A |
| TE-47 | P-12 | 70 | 0.9 | A | A | A |
| TE-48 | P-13 | 60 | 0.8 | B | A | A |
| TE-49 | P-14 | 40 | 1.0 | A | A | B |
| TE-50 | P-15 | 50 | 1.1 | A | B | B |
| TE-51 | P-16 | 40 | 0.9 | A | B | B |
| CE-15 | R-1 | 60 | 1.0 | *6 | — | — |
| CE-16 | R-1 | 10 | 1.0 | A | C | D |
| CE-17 | R-2 | 40 | 0.8 | C | D | C |
| CE-18 | R-3 | 40 | 0.9 | C | C | C |
| CE-19 | R-4 | 70 | 1.0 | C | D | B |
| CE-20 | R-5 | 60 | 1.1 | C | D | C |
| CE-21 | R-6 | 40 | 1.0 | D | — | — |
| CE-22 | R-7 | 60 | 0.9 | C | C | C |

In Table 11:

TE: Test Example

CE: Comparison Example

Mass of Deposit: Mass of deposit as processing agent for synthetic fibers with respect to polyester fibers

*6: Application could not be made because the viscosity of the aqueous liquid of processing agent for synthetic fibers was too high Table 11 shows clearly that the present invention makes it possible not only to apply processing agents for synthetic fibers as an aqueous liquid system with high concentration in the production or fabrication process of synthetic fibers but also to operate with superior spinning property and to obtain synthetic fibers with superior yarn quality and dyeing property.

What is claimed is:

1. A processing agent for synthetic fibers, said processing agent containing Component A in an amount of 20-70 mass %, Component B in an amount of 5-45 mass %, Component C in an amount of 1-20 mass %, Component D in an amount of 5-35 mass %, and Component E in an amount of 1-20 mass % for a total of 100 mass %; wherein said Component A is an ester oil with a total of 10-100 carbon atoms and/or a mineral oil with kinetic viscosity at 30° C. of 1-500 $mm^2/s$;

said Component B is one or more selected from the group consisting of compounds shown by $R^1$—$X^1$—$R^2$, compounds shown by $R^3$—$X^2$—$Y^1$—$X^3$—$R^4$, castor oil derivatives obtained by esterifying (poly)oxyethylene castor oil ether having within its molecule (poly)oxyethylene group formed with 1-100 oxyethylene units and aliphatic monocarboxylic acid with 6-22 carbon atoms, and hydrogenated castor oil derivatives obtained by esterifying (poly)oxyethylene hydrogenated castor oil ether having within its molecule (poly)oxyethylene group formed with 1-100 oxyethylene units and aliphatic monocarboxylic acid with 6-22 carbon atoms, where $R^1$ is a residual group obtained by removing hydrogen atom from carboxyl group of aliphatic monocarboxylic acid with 6-22 carbon atoms, $X^1$ is a residual group obtained by removing all hydroxyl groups from (poly)ethylene glycol having within its molecule (poly) oxyethylene group formed with 1-20 oxyethylene units, $R^2$ is a residual group obtained by removing hydrogen atom from carboxyl group of aliphatic monocarboxylic acid with 6-22 carbon atoms, a residual group obtained by removing hydrogen atom from hydroxyl group of aliphatic monoalcohol with 6-22 carbon atoms, or hydroxyl group, $R^3$ and $R^4$ are each a residual group obtained by removing hydrogen atom from carboxyl group of aliphatic monocarboxylic acid with 6-22 carbon atoms, $X^2$ and $X^3$ are each a residual group obtained by removing all hydroxyl groups from (poly)ethylene glycol having within its molecule (poly)oxyethylene group formed with 1-20 oxyethylene units, $Y^1$ is a residual group obtained by removing hydrogen atom from carboxyl group of aliphatic dicarboxylic acid with 3-12 carbon atoms;

said Component C is an ester of sorbitan and aliphatic monocarboxylic acid with 10-22 carbon atoms;

said Component D is an ethylene oxide and propylene oxide random adduct of aliphatic alcohol with 2-22 carbon atoms with weight average molecular weight of 100-1500; and said Component E is one or more selected from the group consisting of fatty acid salts, aliphatic phosphates and aliphatic sulfonates.

2. The processing agent of claim 1 wherein the ester oil in said Component A is obtained by esterifying aliphatic monoalcohol with 6-22 carbon atoms and aliphatic monocarboxylic acid with 6-22 carbon atoms.

3. The processing agent of claim 2 wherein the mineral oil in said Component A is fluidic paraffin oil with kinetic viscosity at 30° C. of 1-200 $mm^2/s$.

4. The processing agent of claim 1 wherein Component D consists of Component $D^1$ which is an ethylene oxide and propylene oxide random adduct of aliphatic monoalcohol with 2-8 carbon atoms having weight average molecular weight in the range of 600-1200 and Component $D^2$ which is an ethylene oxide and propylene oxide random adduct of aliphatic monoalcohol with 10-18 carbon atoms having weight average molecular weight in the range of 300-900 such that the mass ratio of Component $D^1$ with respect to the sum of Component $D^1$ and Component $D^2$ is in the range of 0.20-0.60.

5. The processing agent of claim 3 wherein Component D consists of Component $D^1$ which is an ethylene oxide and propylene oxide random adduct of aliphatic monoalcohol with 2-8 carbon atoms having weight average molecular weight in the range of 600-1200 and Component $D^2$ which is an ethylene oxide and propylene oxide random adduct of aliphatic monoalcohol with 10-18 carbon atoms having weight average molecular weight in the range of 300-900 such that the mass ratio of Component $D^1$ with respect to the sum of Component $D^1$ and Component $D^2$ is in the range of 0.20-0.60.

6. An aqueous liquid of processing agent for synthetic fibers comprising a processing agent of claim 1 for synthetic fibers in an amount of 40-90 mass % and water in an amount of 10-60 mass % for a total of 100 mass %, being evaluated to be stable by a specified evaluation method and having kinetic viscosity of 50-300 $mm^2/s$ as measured by a specified measurement method;

said specified evaluation method comprising the steps of preparing sample aqueous liquids of 100 ml each with concentrations of said processing agent respectively 40 mass %, 50 mass %, 60 mass %, 70 mass % and 90 mass %, leaving each of said sample aqueous liquids quietly in a 200 ml beaker with an open top for 2 weeks at 40° C., and evaluating as stable those of said samples without separation; and said specified measurement method comprising the steps of preparing sample aqueous liquids of 100 ml each with concentrations of said processing agent respectively 40 mass %, 50 mass %, 60 mass %, 70 mass % and 90 mass %, and measuring kinetic viscosity at 30° C. of each of said sample aqueous liquids by a Canon-Finske method in units of $mm^2/s$.

7. An aqueous liquid of processing agent for synthetic fibers comprising a processing agent of claim 3 for synthetic fibers in an amount of 40-90 mass % and water in an amount of 10-60 mass % for a total of 100 mass %, being evaluated to be stable by a specified evaluation method and having kinetic viscosity of 50-300 $mm^2/s$ as measured by a specified measurement method;

said specified evaluation method comprising the steps of preparing sample aqueous liquids of 100 ml each with concentrations of said processing agent respectively 40 mass %, 50 mass %, 60 mass %, 70 mass % and 90 mass %, leaving each of said sample aqueous liquids quietly in a 200 ml beaker with an open top for 2 weeks at 40° C., and evaluating as stable those of said samples without separation; and said specified measurement method comprising the steps of preparing sample aqueous liquids of 100 ml each with concentrations of said processing agent respectively 40 mass %, 50 mass %, 60 mass %, 70 mass % and 90 mass %, and measuring kinetic viscosity at 30° C. of each of said sample aqueous liquids by a Canon-Finske method in units of $mm^2/s$.

8. A processing method of synthetic fibers comprising the step of depositing an aqueous liquid of claim 6 to become adhered to said synthetic fibers in an amount of 0.1-5 mass % as processing agent with respect to said synthetic fibers.

9. A processing method of synthetic fibers comprising the step of depositing an aqueous liquid of claim 7 to become adhered to said synthetic fibers in an amount of 0.1-5 mass % as processing agent with respect to said synthetic fibers.

10. The processing method of claim 8 wherein said aqueous liquid comprises said processing agent in an amount of 40-70 mass % and water in an amount of 30-60 mass % for a total of 100 mass %.

11. The processing method of claim 9 wherein said aqueous liquid comprises said processing agent in an amount of 40-70 mass % and water in an amount of 30-60 mass % for a total of 100 mass %.

12. Synthetic fibers obtained by the processing method of claim 8.

13. Synthetic fibers obtained by the processing method of claim 9.

14. Synthetic fibers obtained by the processing method of claim 10.

15. Synthetic fibers obtained by the processing method of claim 11.

* * * * *